US009993042B1

(12) United States Patent
Miller

(10) Patent No.: US 9,993,042 B1
(45) Date of Patent: Jun. 12, 2018

(54) HEADGEAR SYSTEM THAT INCLUDES EASILY COUPLED CAP AND OUTER HEAD COVERING AND THAT HELPS TO PROTECT AGAINST VISION OBSTRUCTION

(71) Applicant: George Miller, Hastings, MN (US)

(72) Inventor: George Miller, Hastings, MN (US)

( * ) Notice: Subject to any disclaimer, the term of this patent is extended or adjusted under 35 U.S.C. 154(b) by 0 days. days.

(21) Appl. No.: 14/669,865

(22) Filed: Mar. 26, 2015

Related U.S. Application Data

(60) Provisional application No. 61/971,395, filed on Mar. 27, 2014.

(51) Int. Cl.
*A42B 1/06* (2006.01)
*A42B 1/04* (2006.01)
*A42B 3/00* (2006.01)

(52) U.S. Cl.
CPC ..... *A42B 1/041* (2013.01); *A42B 1/048* (2013.01); *A42B 3/003* (2013.01)

(58) Field of Classification Search
CPC ..... A42B 1/041; A42B 1/048; A42B 3/003; A42B 1/04; A42B 1/18; A42B 7/00; A42C 5/04; A42C 1/064; A42C 1/062; A42C 1/06; A42C 1/061; A42C 1/048; A41D 3/02; A41D 3/04
USPC ..... 2/410, 84, 108, 202, 209.12, 109.13, 2/175.1, 171.1, 205, 175.6, 195.1, 5, 6.2, 2/6.6, 421, 422, 425
See application file for complete search history.

(56) References Cited

U.S. PATENT DOCUMENTS 1,214,128 A * 1/1917 Brooks ..... A42B 7/00 2/175.6
1,726,936 A * 9/1929 Turgeon ..... A42B 1/18 2/175.6
3,031,673 A * 5/1962 Korolick ..... A42B 3/003 2/209
3,100,896 A * 8/1963 Khanbegian ..... A42B 3/105 2/205
3,166,766 A * 1/1965 Banello, Jr. ..... A42B 1/18 2/175.6
3,469,264 A * 9/1969 Harris ..... A42B 1/045 2/172
4,091,469 A * 5/1978 Davidson ..... A42B 3/105 2/410

(Continued)

OTHER PUBLICATIONS

"2 Raincoats: Nau Succinet Trench and Lululemon Ride on Rain Jacket," Apr. 1, 2012, http://web.archive.org/web/20120717193031/http://lovelybike.blogspot.com/2012/04/2-raincoats-nau-succinct-trench-and.html.*

(Continued)

*Primary Examiner* — Jameson Collier
*Assistant Examiner* — Heather Mangine
(74) *Attorney, Agent, or Firm* — Kagan Binder, PLLC

(57) ABSTRACT

A head covering system comprises a cap as an inner component and an outer head covering that cooperate to help protect the head from the elements but helps to protect against vision obstruction when the head is moved. A headgear system comprises a cap having a head engaging portion and a visor that engages and moves with the head of the user. An outer covering fits over the cap and at least a portion of the head of the user comprises head covering portion, an optionally a neck covering portion, and a bill attached to the head covering portion.

16 Claims, 7 Drawing Sheets

(56) References Cited

U.S. PATENT DOCUMENTS

| | | | | | |
|---|---|---|---|---|---|
| 4,329,742 | A * | 5/1982 | Schuessler | A42B 3/10 | 2/195.8 |
| 4,980,928 | A | 1/1991 | Ellis | | |
| 5,062,163 | A * | 11/1991 | Avey | A42B 1/067 | 2/410 |
| 5,592,696 | A * | 1/1997 | Oliver | A42B 1/02 | 2/175.3 |
| 5,623,732 | A | 4/1997 | Olajide, Jr. | | |
| 5,694,647 | A | 12/1997 | Crickmore | | |
| 5,694,648 | A | 12/1997 | Nucifora | | |
| 5,771,493 | A | 6/1998 | Proctor | | |
| 5,790,986 | A | 8/1998 | Hall | | |
| 5,832,538 | A | 11/1998 | Williams | | |
| 6,052,830 | A * | 4/2000 | Payne | A42B 1/045 | 2/12 |
| 6,966,072 | B1 | 11/2005 | Kobayashi | | |
| 6,996,852 | B1 * | 2/2006 | Cabrera | A42B 1/062 | 2/171 |
| 7,117,542 | B2 * | 10/2006 | Lee | A42B 1/062 | 2/175.1 |
| 7,380,286 | B1 * | 6/2008 | Bryant, Sr. | A42B 1/048 | 2/202 |
| 7,917,970 | B2 | 4/2011 | Shimshony | | |
| 7,971,278 | B2 * | 7/2011 | Klamerus, Jr. | A42B 1/18 | 2/172 |
| 8,051,497 | B1 * | 11/2011 | Erhardt | 2/175.6 | |
| 8,438,665 | B2 | 5/2013 | Roemer et al. | | |
| 9,149,085 | B2 * | 10/2015 | Bryan | A42B 3/0406 | |
| 9,220,854 | B1 | 12/2015 | Okrusko | | |
| 9,232,822 | B1 | 1/2016 | Khubani | | |
| 9,245,180 | B1 | 1/2016 | Hansen | | |
| 9,248,322 | B2 | 2/2016 | Yadav et al. | | |
| 2001/0004773 | A1 * | 6/2001 | Moore | A42B 3/003 | 2/425 |
| 2005/0241045 | A1 * | 11/2005 | Tolton | A42B 1/048 | 2/84 |
| 2005/0246825 | A1 * | 11/2005 | Ruhl | 2/422 | |
| 2011/0252539 | A1 * | 10/2011 | Scott | A42B 1/062 | 2/209.5 |
| 2013/0042384 | A1 * | 2/2013 | Mitchell | A42B 1/048 | 2/84 |

OTHER PUBLICATIONS

Precision Urethane and Machine Co., Flexible Solutions Through Polymeric Innovation, Polyurethane Sheets, http://www.precisionurethane.com/urethane-sheets.html, 2008-2016, pp. 1-2.

RTP Co., Rigid Polyurethane (RTPU), http://www.rtpcompany.com/products/product-guide/rigid-polyurethane-rtpu/, 1995-2015, p. 1.

CW CompositesWorld, Structural Polyurethanes: Bearing Bigger Loads, http://www.compositesworld.com/articles/structural-polyurethanes-bearing-bigger-loads, Mar. 10, 2010, pp. 1-5.

* cited by examiner

HEADGEAR SYSTEM THAT INCLUDES EASILY COUPLED CAP AND OUTER HEAD COVERING AND THAT HELPS TO PROTECT AGAINST VISION OBSTRUCTION

PRIORITY

This application claims priority to U.S. Provisional Application No. 61/971,395, filed Mar. 27, 2014, titled "HEADGEAR SYSTEM THAT INCLUDES EASILY COUPLED CAP AND OUTER HEAD COVERING AND THAT HELPS TO PROTECT AGAINST VISION OBSTRUCTION", the entire disclosure of which is incorporated herein for all purposes.

FIELD OF THE INVENTION

The present invention relates to head coverings. More specifically, the present invention relates to a head covering system comprising a cap as an inner component and an outer head covering that cooperate to help protect the head from the elements but helps to protect against vision obstruction when the head is moved.

BACKGROUND OF THE INVENTION

Outerwear garments such as raincoats, ski jackets, fishing jackets, hunting jackets, and other kinds of jackets often include a hood to help protect the wearer's head and upper body from the elements. Hoods may be permanently attached, or they may be detachable. In many instances, the hoods are water resistant or waterproof to help keep the head and upper body dry from precipitation.

Head coverings such as hoods often obstruct the vision of the wearer because the head may tend to move too independently relative to the hood. For example, a hood attached to a jacket will either not turn or not turn completely with a turn of the head. Thus, when a person turns his head to the left (or right) and attempts to look left (or right), the hood may remain substantially in its original position, or near to its original position. This obstructs the view to the left (or right). This problem is illustrated in FIG. 1*a*, described further below, where one eye of the user is completely covered and obstructed by the hood. The other eye is partially covered which further obstructs the left view of the user.

The problem is particularly acute in jackets and coats designed for sportsmen such as fisherman, hunters, campers, hikers, etc. Typically the hooded jackets for sportsmen are designed to provide maximum protection in extreme conditions. Thus, the hood needs to protect the user's face and upper body by wrapping around the side of the face and extending beyond the face from above. In addition, to be comfortable, the hood should provide spacing between the user's head and the hood so that at least some ventilation around the hood is possible. Otherwise, the hood might cause condensation on eye glasses and may retain moisture that eventually will wet the head of the user. A relatively loose fitting hood often is more comfortable in the rain, because a tight fitting hood causes the user to actually feel raindrops on his head and neck. Also, a loose fitting hood is desirable to accommodate other head coverings that the user may wish to wear, such as a cap with a visor.

The advantages of a large, relatively loose fitting hood create corresponding problems. A large loose fitting hood exacerbates the obstruction problem as illustrated in FIG. 1*a*. Although a large, relatively loose hood provides desirable ventilation, such a configuration may tend to allow the hood to be blown from the user's head or be moved to an undesirable position. These problems are addressed by the present invention.

SUMMARY OF THE INVENTION

The present invention relates to head coverings. More specifically, the present invention relates to a head covering system comprising a cap as an inner component and an outer head covering that cooperate to help protect the head from the elements but helps to protect against vision obstruction when the head is moved.

In one aspect, the present invention relates to a headgear system, comprising:

(a) a cap that engages a head of a user and that moves with the head of the user, said cap comprising:
  (i) a head engaging portion that engages the head of the user; and
  (ii) a visor extending outward from the skull engaging portion; and (b) an outer covering (such as a hood or the like) configured to fit over the cap and over at least a portion of the head of the user, said outer covering comprising:
  (i) a head covering portion covering at least a portion of the head of the user, said head covering portion having a face opening comprising a perimeter, and;
  (ii) optionally a neck covering portion covering at least a portion of the neck of the user; and
  (ii) a bill attached to the head covering portion and extending outward from the head covering portion and a perimeter of the face opening, said bill comprising at least an upper panel and a lower panel defining at least a portion of a pocket, wherein at least a portion of the visor of the cap fits into at least a portion of the pocket in order to physically couple the outer covering to the cap such that a movement of the cap causes a corresponding movement of the outer covering.

In another aspect, the present invention relates to a method of wearing a headgear system on a head of a user, comprising the steps of:

(a) wearing a cap that engages the head and moves with the head, said cap comprising:
  (i) a head engaging portion that engages the head; and
  (ii) a visor extending outward from the skull engaging portion; and (b) wearing an outer covering that fits over the cap and over at least a portion of the head, said outer covering comprising:
  (i) a head covering portion covering at least a portion of the head of the user, said head covering portion having a face opening comprising a perimeter, and;
  (ii) optionally a neck covering portion covering at least a portion of the neck of the user; and
  (ii) a bill attached to the head covering portion and extending outward from the head covering portion and a perimeter of the face opening, said bill comprising at least an upper panel and a lower panel defining at least a portion of a pocket, wherein at least a portion of the visor of the cap fits into at least a portion of the pocket in order to physically couple the outer covering to the cap such that a movement of the cap causes a corresponding movement of the outer covering; and (c) fitting the visor of the cap into the pocket of the outer covering.

In another aspect, the present invention relates to a method of making a headgear system, comprising the steps of:

(a) providing a head covering comprising that fits over a cap and over at least a portion of a user's head, said head covering comprising:
  (i) a head covering portion configured to cover at least a portion of the head of the user, said head covering portion having a face opening comprising a perimeter, and;
  (ii) optionally a neck covering portion covering at least a portion of the neck of the user; and
  (ii) a bill attached to the head covering portion and extending outward from the head covering portion and a perimeter of the face opening, said bill comprising at least an upper panel and a lower panel defining at least a portion of a pocket configured to receive at least a portion of a visor of a cap in order to physically couple the head covering to the cap such that a movement of the cap causes a corresponding movement of the outer covering; and (b) causing the head covering to be worn by a user also wearing a cap having a visor in a manner such that at least a portion of the cap is inside the head covering and at least a portion of the visor of the cap is fitted into the pocket of the head covering.

The present invention provides many advantages. In contrast to many conventional headgear systems, the head covering component of the present invention works with a wide range of cap sizes and shapes. Many different cap configurations are easily coupled to the head covering component without requiring any customization or special features on the cap component. Thus, many caps can be immediately used in the system without having to add snaps or straps and ruining the aesthetics of a cap that may be used in other contexts.

The system is very durable. The system does not require pulling or pushing on snaps or straps that can stress headgear components and that can cause headgear components to wear and tear. Also, unlike relying only on snaps or straps or other mechanical fasteners, using a pocket to couple the headgear components more effectively distributes movement stresses over a wider area of the components. This also helps to avoid wear and tear associated with other systems.

The system is easier to manufacture. The present invention allows for effective integration into pre-existing garment designs without the addition of new or cumbersome parts and manufacturing processes and designs.

The system is very effective at protecting the user from the elements, e.g., wind, rain, snow, sleet, hail, or the like, but easily moves with the user's head to help avoid vision obstruction. The system also increases safety, because the system helps to keep headwear such as a hood in proper position to avoid vision obstruction. This is very helpful when the wearer operates equipment such as machinery and tools for construction work, vehicles such as boats, atv's, and the like for work, transport or recreation.

The cap and outer head covering are easy and fast to attach and detach in a wide range of conditions, even in the dark or other adverse conditions. Using a pocket, the cap and outer head covering are easy to align, for example, and in effect are self-aligning. There is no need to fumble with straps or to risk mis-snapping features on one side of the cap with the wrong snapping feature (analogous to mis-buttoning a shirt) on the head covering. This is a significant advantage for many workers. For example, forestry, construction, or other workers often wear helmets with visors when working outside, particularly in inclement weather. With the present invention, the visor of the helmet easily slides into the pocket without requiring any modification to the helmet. This is a significant advantage, because modifying a helmet is not a trivial task (to include snaps or similar). Modifications could reduce the effectiveness of a helmet and void its required safety rating.

Although open pockets can be used in the outer covering to receive the cap visor, closed pockets help to more fully enclose and protect the cap. Thus, both the user and the cap are protected from the elements in these embodiments.

DETAILED DESCRIPTION OF PRESENTLY PREFERRED EMBODIMENTS

Figure 1A:
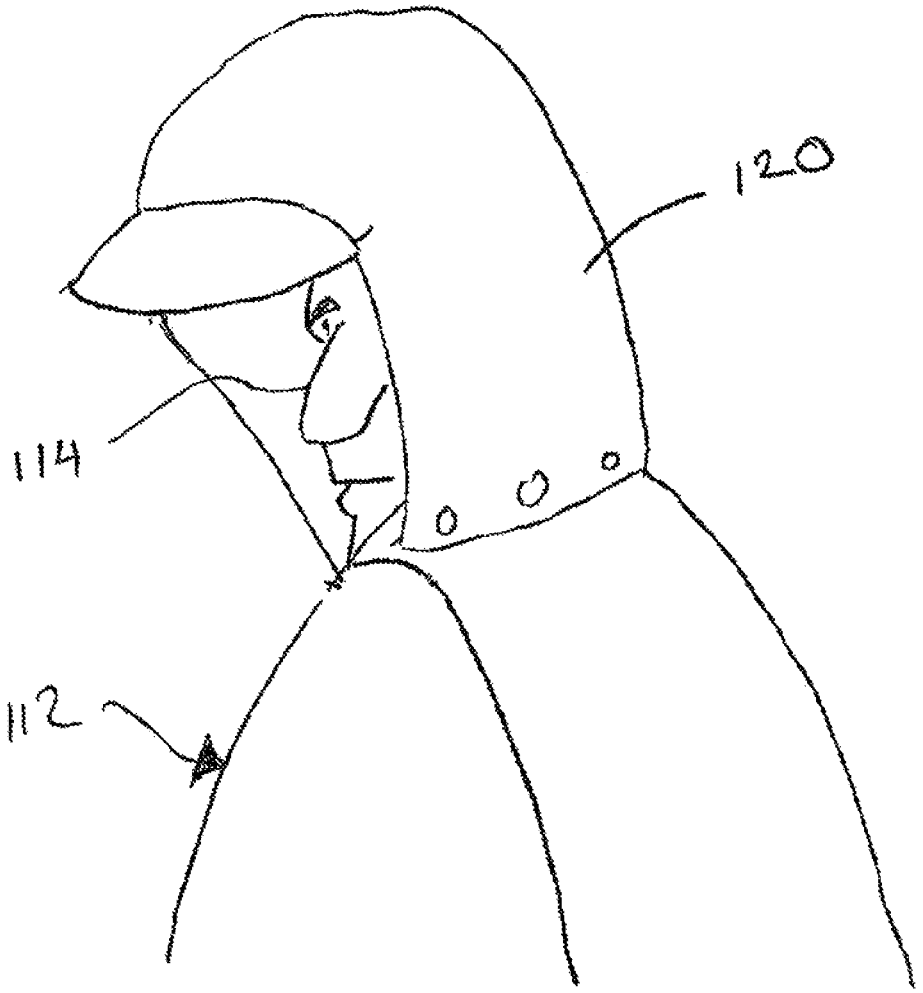
Fig. 1a (prior art)
FIG. 1*a* shows a person wearing a conventional hood of the prior art that tends to obscure vision when the person moves his or her head.
Figure 1B:
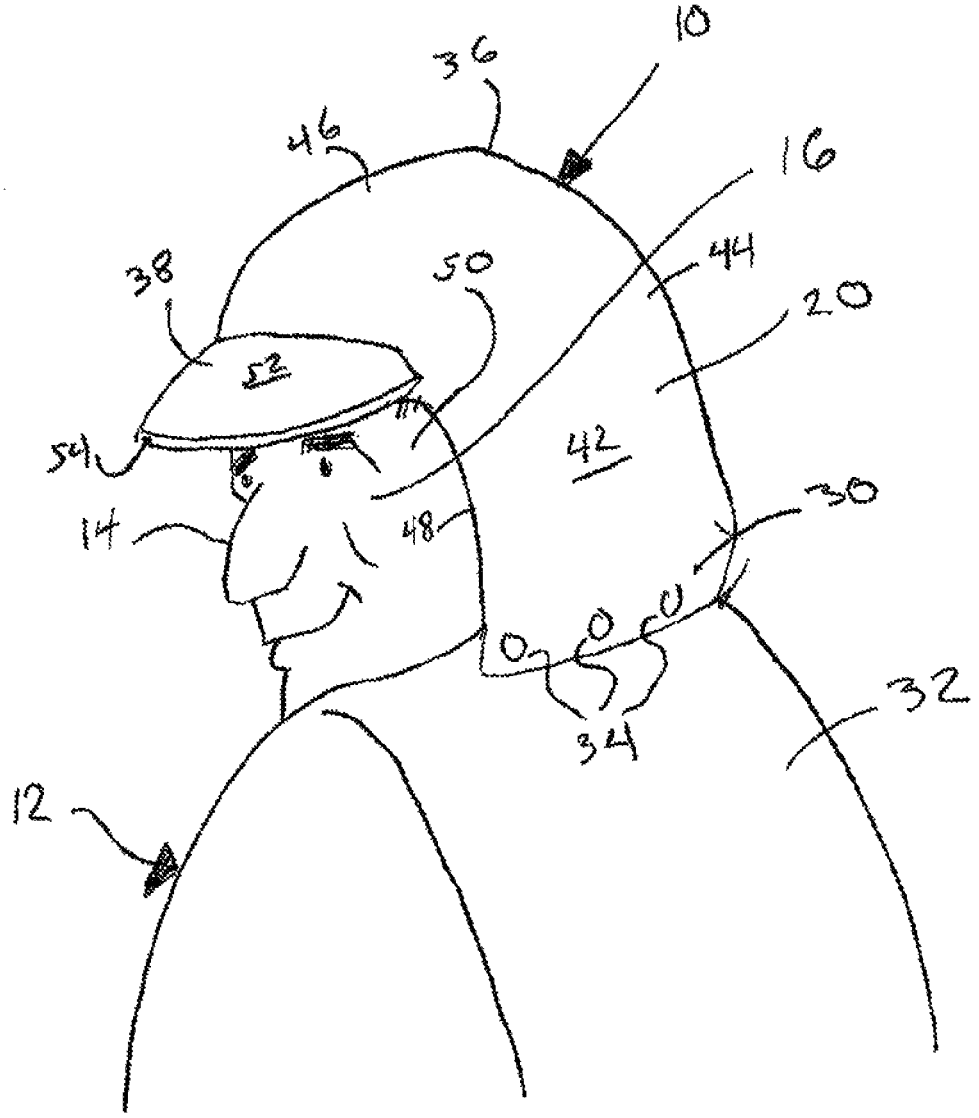
FIG. 1*b* shows a person wearing a headgear system of the present invention that helps to protect against vision obstruction.

The embodiments of the present invention described below are not intended to be exhaustive or to limit the invention to the precise forms disclosed in the following detailed description. Rather a purpose of the embodiments chosen and described is so that the appreciation and understanding by others skilled in the art of the principles and practices of the present invention can be facilitated.

An illustrative embodiment of a headgear system 10 according to the present invention is shown in FIG. 1*b* through 7. Headgear system 10 is worn by a user 12 whose head 14, neck 15, and face 16 are protected and shaded by system 10.

Headgear system 10 generally includes a cap 18 and further head covering 20. Cap 18 and head covering 20 are configured so that in many modes of practice, head covering 20 provides an outer head covering fitting over at least portions of both cap 18 as well as at least portions of the head 14 and neck 15 of user 12. In other modes of practice, only cap 18 is worn while head covering 20 is lowered, detached and stored, or otherwise not placed around cap 18 and head 14. In other modes of practice, user 12 might wear only head covering 20, while cap 18 is not worn. In other modes of practice, neither cap 18 nor head covering 20 are worn.

When worn, cap 18 engages the head 14 of user 12 and moves with the head 14. For example, if the user turns head 14 and face 16 to the right (or left), cap 18 moves to the right (or left) in a corresponding fashion. If the user 12 moves head 14 and face 16 up (or down), cap 18 moves up (or down) in a corresponding fashion. Consequently, when cap 18 is physically coupled to head covering 20 in the manner taught by the present invention, the head covering 20 moves in a corresponding fashion. Face 16 and vision of user 12 remain substantially unobscured by head movement. For example, in FIG. 1*b*, the user 12 is wearing headgear system 10 of the present invention in which cap 18 (not shown in FIG. 1*b*, but worn by user 12 underneath the outer head covering 20) is looking to the left. Both cap 18 and head covering 20 have turned left with the gaze of user 12. In other words, head 14 and outer head covering 20 move in tandem because cap 18 helps to physically couple head 14 to the outer head covering 20. Consequently the face 16 and vision of user 12 are not unduly obstructed by head covering 20.

In contrast, and as described above with respect to FIG. 1*a*, user 112 is wearing a head covering 120 that is not coupled to an underlying cap (not shown). Without coupling of a cap to the head covering 120, the head 114 can move independently of the head covering 120. Head 114 and head covering 120 do not move in tandem. As shown, this can cause the uncoupled head covering 120 to block and thereby obscure the vision of user 112.

Figure 5:
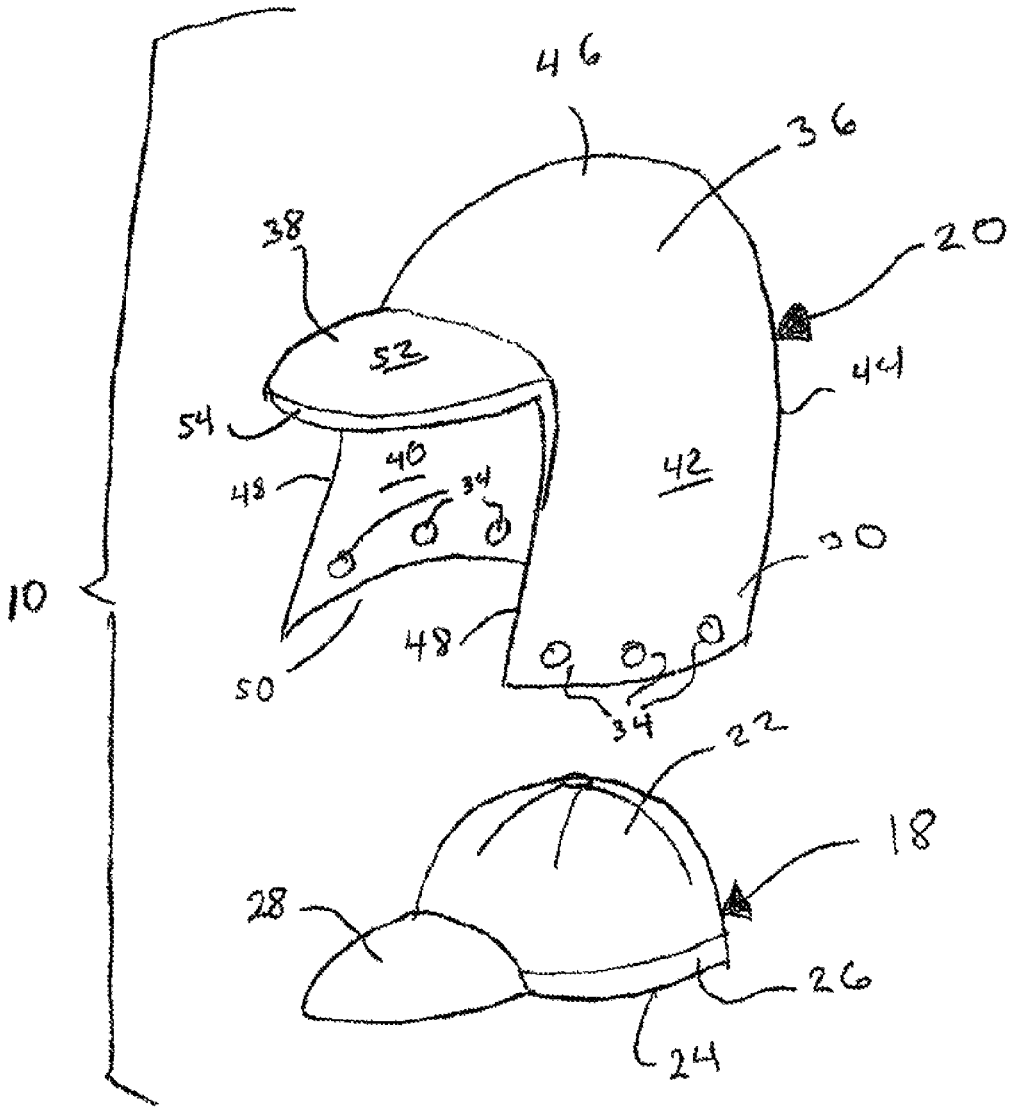
FIG. 5 shows an illustrative embodiment of a headgear system of the present invention comprising the head covering as a first component and a cap as a second component.
Figure 6:
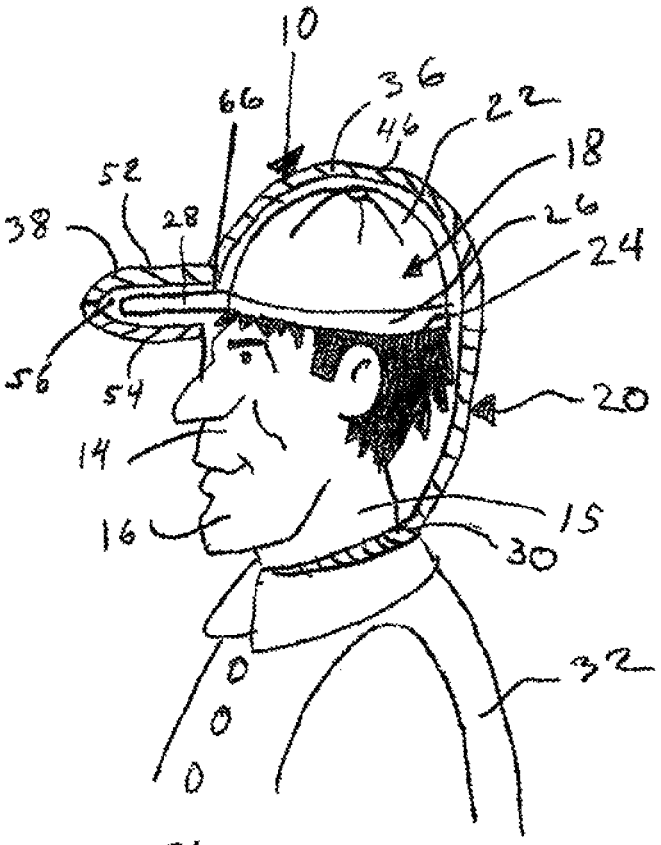
FIG. 6 schematically shows a person wearing the headgear system of FIG. 5 in a first configuration with the head covering schematically shown in cross-section to illustrate how the visor on the cap fits into a pocket in the bill of head covering component.
Figure 7:
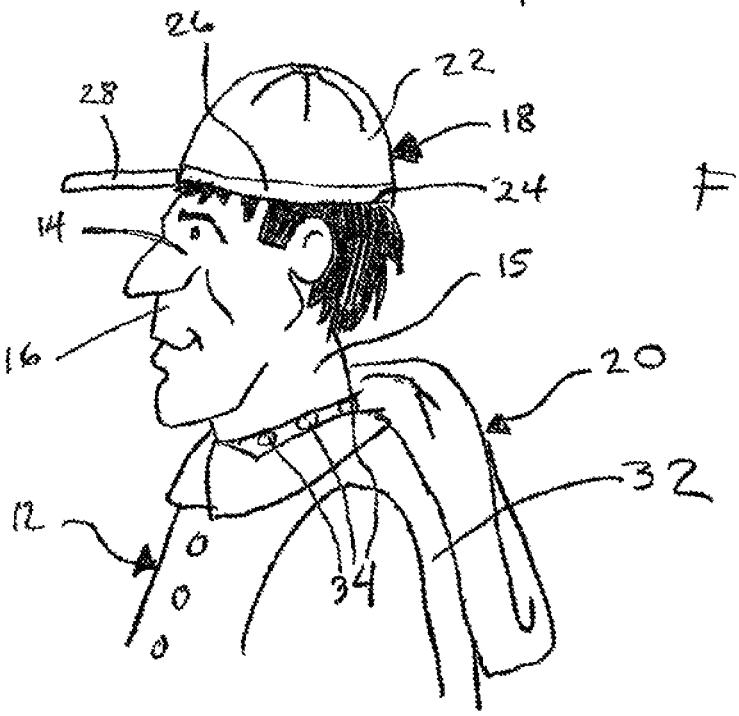
FIG. 7 shows the person of FIG. 6 wearing the headgear system of FIG. 5 in a second configuration in which the head covering is lowered but the person is still wearing the cap.

As shown best in FIGS. 5, 6, and 7, cap 18 includes a head engaging portion 22 that helps to cover at least a portion of the head 14 of the user 12. The lower perimeter 24 of head engaging portion 22 often is fitted with an optional headband 26 for purposes such as to help increase comfort or to help provide adjustment of the fit of head engaging portion 22. For example, headband 26 may have stretching characteristics to help adjust to head 14. As an alternative or in addition to such characteristics, headband 26 may include adjustment features (not shown) to allow the size of headband 26 to be adjusted. Adjustment features are well known and include adjustable straps, snaps, draw strings, combinations of these, and the like.

Cap 18 includes a visor 28 that extends outwardly from head engaging portion 22. In many instances, visor 28 extends outward from the brow of user 12 to help shade and protect the face 16 of the user 12.

An advantage of the present invention is that a wide variety of caps in a variety of sizes and configurations can be used in system 10. Unlike many conventional devices described in the prior art, in most instances caps can be commercially purchased and incorporated into system 10 without any modification. Although optional mechanical features (e.g., snaps, zippers, ties, hook and loop fasteners, buttons, clips, magnets, combinations of these, and the like) may be added to cap 18 to secure to the head covering 20, mechanical features are not needed and often are not desirable by the user in many embodiments as these may require permanent modification or impair the aesthetics of the cap when head covering 20 is not worn. An important advantage of the present invention is the ability of cap 18 and head covering 20 to engage so easily via the pocket feature described below without needing additional or special fasteners or other customization. This engagement also helps to properly align the head covering 20 on the head 14 of user 12.

Referring again collectively to FIG. 1*b* through 7, system 10 further includes head covering 20. In this embodiment, head covering 20 is in the form of a hood. As illustrated, a lower portion 30 of head covering 20 is attached to the optional jacket 32 worn by the user 12. If jacket 32 is worn, head covering 20 may be detachable to jacket 32. Alternatively, head covering may be permanently attached to jacket 32. For purposes of illustration, head covering 20 as illustrated is detachable and is attached to jacket 32 by snaps 34. Other detachable features include zippers, hook and loop attachment (such as is available under the trade designation VELCRO®), buttons, clips, magnets, combinations of these, and the like. A wide variety of techniques for permanent attachment may be used, if desired. These include one or more of stitches, gluing, riveting, fusing or other welding, forming from a single integral piece, combinations of these, and the like.

Head covering 20 provides an outer head covering over at least portions of cap 18, head 14, and optionally neck 15. Head covering 20 generally includes a hood body 36 and bill 38. Hood body 36 as illustrated includes right and left side portions 40, 42, rear portion 44, and top portion 46. In the front, hood body 36 includes perimeter 48 helping to define face opening 50 through which user 12 may gaze without being unduly obstructed by head covering 20.

Bill 38 is attached to hood body 36 in this embodiment and projects outwardly generally from the brow of the user 12. Bill 38 is positioned to align with visor 28 to allow the cap 18 and the head covering 20 to be physically coupled at least by pocket features incorporated into head covering 20.

Bill 38 includes upper panel 52 and lower panel 54 that are coupled in a manner effective to form pocket 56 so that at least a portion of visor 28 of cap 18 fits into at least a portion of the pocket 56. This provides an extremely easy way to protect and fit cap 18 inside head covering 20 and to reversibly couple cap 18 to head covering 20 without requiring customization or adding special features to cap 18. Due to the coupling, movement of the cap 18 causes a corresponding movement of the head covering 20.

Figure 4:
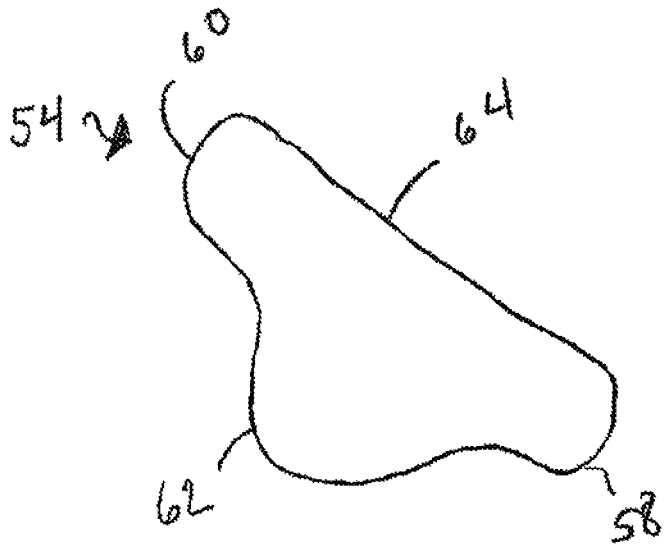
FIG. 4 shows a top view of the lower panel of FIG. 2.

FIG. 4 shows a top view of lower panel 54. Lower panel 54 as well as upper panel 52 independently may be formed from material(s) of any type such as any rigid, semi-rigid, and/or flexible panel suitable for forming pocket 56. In many embodiments, lower panel 54 is flexible to allow lower panel to more easily conform to non-flat visors 28. In some embodiments, lower panel 54 may be formed from a stretchable fabric. This allows lower panel 54 to stretch and thereby provide a close fit with visor 28 held inside pocket 54. Stretchable characteristics also allow pocket 56 to fit a wide variety of visors with different shapes and sizes. Upper panel 52 and lower panel 54 independently may be formed from the same or different material(s) used to form other portions of head covering 20.

Upper panel 52 and lower panel 54 may have multi-layer structures in which some layers have different properties than other layers. For example, inner layers may provide insulation, lining, aesthetic, and or stretchability functions, while outer layer(s) may provide protection from the ambient or the like.

As shown in FIG. 4, lower panel 54 includes left, right, front and rear edges 58, 60, 62, and 64, respectively. In many embodiments, edges 58, 60, and 62 are permanently or detachably attached to bill 38 and/or other portions of head covering 20, while at least a portion of rear edge 6 is not secured to provide opening 66 for egress to and from pocket 56. This allows visor 28 of cap 18 to easily slide into the sleeve or pocket 56 that is created. Desirably, the entirety of the other edges 58, 60, and 62 are coupled to bill 38 and/or other portions of head covering 20 along substantially the entirety of their respective lengths so that pocket 56 is able to provide a weather resistant enclosure around at least visor 28 of the cap 18. For example, the edges 58 and 60 are extensions of the lower panel 54 that couple to the head covering 20 and that extend downward from and away from the upper panel 52. Alternatively, portions of edges 58, 60, and 62 may be open for ventilation or the like and/or so that a portion of visor 28 projects outward from head covering 20, if desired. Consequently, the dimensions of lower panel 54 may be selected from a wide range, but are sufficiently sized to allow at least a portion of visor 28 to fit inside pocket 56.

Figure 2:
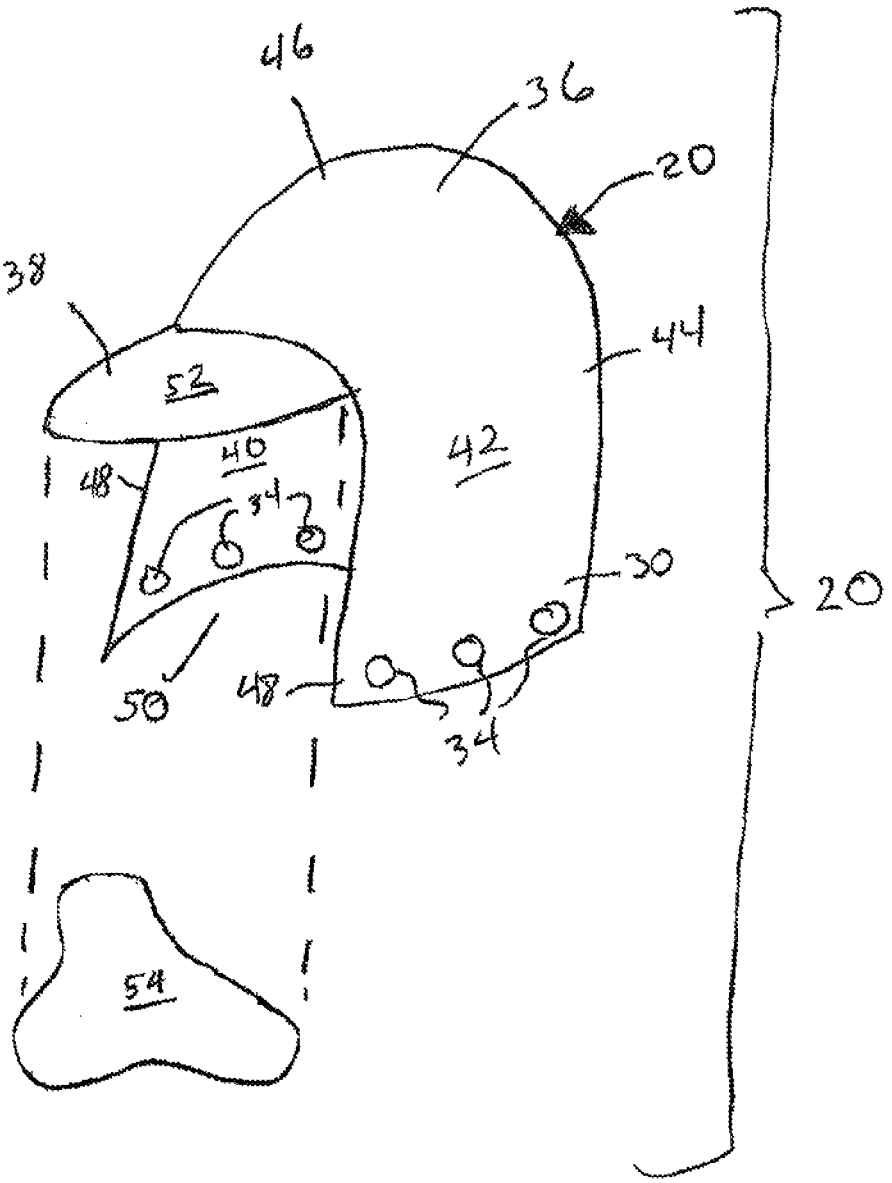
FIG. 2 shows how a head covering as a first component of the present invention can be assembled by coupling a lower panel to the upper panel on the bill of ahead covering portion.

FIGS. 2 through 5 schematically show an illustrative method for making a headgear system 10 of the present invention. In FIG. 2, a first step involves providing a head engaging portion 22 configured to cover at least a portion of the head 14 of the user 12. Preferably, the head engaging portion 22 is sized to cover at least portions of both the head 16 and neck 15 of the user 12. Upper panel 52 is integral with or is a separate component attached to head engaging portion 22. The head covering portion 20 has a face opening 50 defined at least in part by perimeter 48. In the meantime, lower panel 54 is provided as a separate component.

Figure 3:
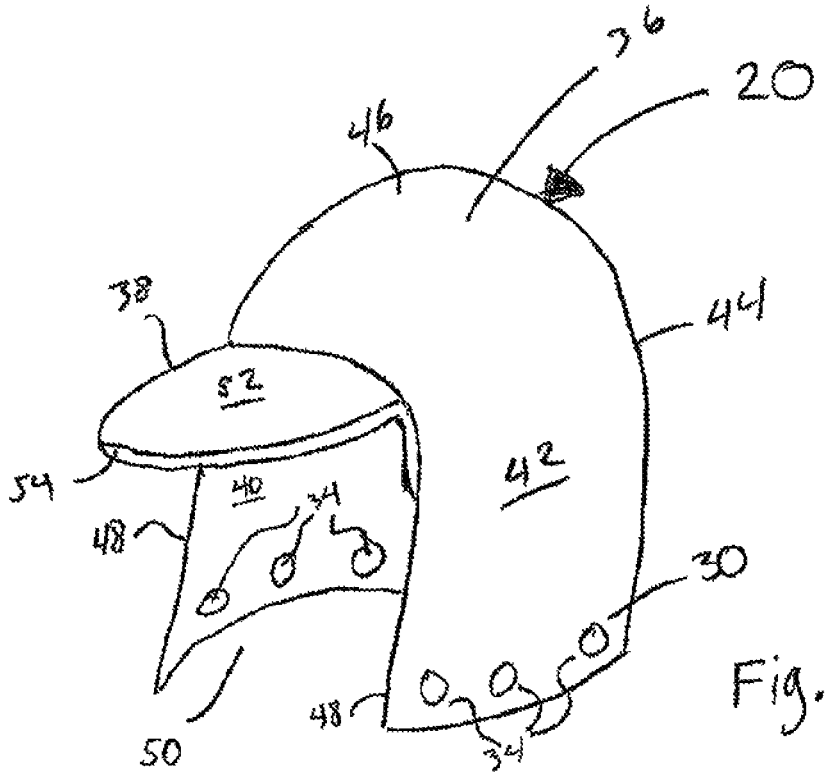
FIG. 3 shows an assembled head covering as a first component of the present invention after the lower panel of FIG. 2 is coupled to the upper panel on the bill of the head covering portion.

In FIG. 3, lower panel 54 is attached to upper panel 52 and/or portions of the head covering 22 to thereby provide head covering 20 including bill 38 having pocket 56 (not viewable in FIG. 3). In FIG. 4, the cap 18 is provided. The combination of cap 18 and head covering 20 may then be worn by user 12 as shown in FIGS. 1*a* and 5. There, user 12 is wearing both cap 18 and head covering 20. Cap 18 fits inside head covering 20, with visor 28 fitting within and being enclosed by pocket 56. In the meantime, cap 18 is provided as shown in FIG. 5.

To assemble system 10 according to one illustrative mode of practice, the user 12 may first place cap 18 on the user's head 14 with visor 28 facing in the desired direction, e.g., forward from the face 16 of the user 12. Head covering 20 is then raised over the cap 18. Visor 28 is placed into pocket 56 in bill 38 of the head covering 20. This immediately and easily positions head covering 20 properly on the head 14.

System 10 is now assembled into a first configuration and worn by user 12 as shown in FIG. 6. Cap 18 and head covering 20 are now coupled so that head covering 20 moves in concert with cap 18 and head 14. This allows user 12 to move his or her head 14 right or left, or up or down, or otherwise without unduly obstructing vision or undue exposure to the elements. Alternatively, in other illustrative modes of practice, cap 18 may be installed into head covering 20 first, and then the combination is placed on the user's head 14.

In FIG. 7, the user 12 is shown wearing system 10 in an alternative configuration. User 12 is still wearing cap 18, but head covering 20 has been independently lowered. An advantage of the present invention is that it is very easy for the user 12 to switch from the configuration shown in FIG. 6 to that shown in FIG. 7, or vice versa, by simply inserting or removing at least a portion of visor 28 from pocket 56 as desired. Switching between such modes is fast and can be done easily under adverse weather conditions or when it is dark. Inside head covering 20, both cap 18 and user 12 are well protected from the elements.

Figure 8:
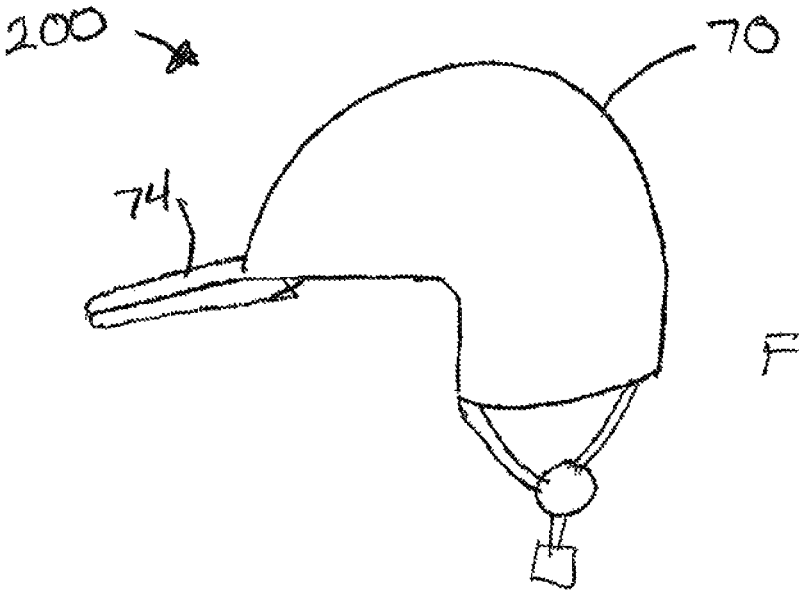
FIG. 8 shows a side view of an alternative embodiment of a headgear system of the present invention comprising a cap and a helmet.
Figure 9:
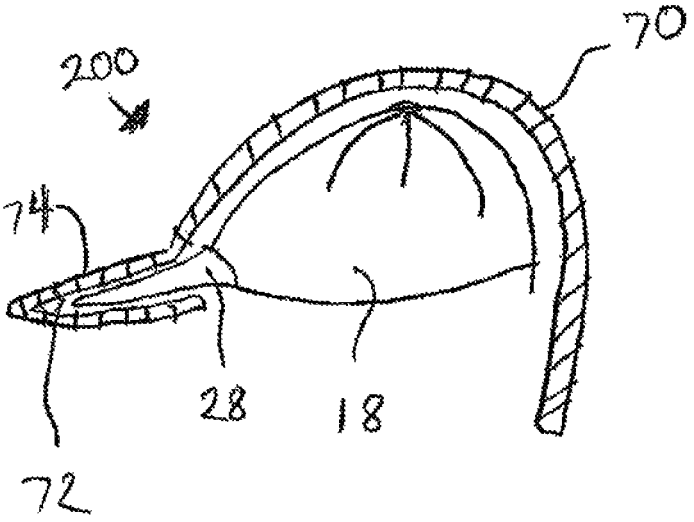
FIG. 9 schematically shows a side view of the headgear system of FIG. 8 with the helmet of that system shown in cross-section to illustration how the visor on the cap fits into a pocket in the bill of the helmet.

FIG. 1*b* through 7 show how the present invention can be incorporated into the combination of cap and hood structures. Alternative headgear combinations also are within the scope of the present invention. For example, FIGS. 8 and 9 show an embodiment 200 of the present invention that is a combination of cap 18 with helmet 70. Helmet 70 may be a bicycle, ski, motorcycle, are other kind of helmet. When both cap 18 and helmet 70 are worn by user 12, cap 18 fits inside helmet with at least a portion of visor 28 fitting into pocket 72 in the bill 74 of helmet 70. In such a combination, the combination of helmet 70 and cap 18 help to keep user 12 warm in colder weather. User 12 also may remove helmet 70 while still wearing cap 18. This allows user 12 to avoid displaying so called "helmet hair" to the public when helmet 70 is removed.

All patents, patent applications, and publications cited herein are incorporated by reference as if individually incorporated. Unless otherwise indicated, all parts and percentages are by weight and all molecular weights are number average molecular weights. The foregoing detailed description has been given for clarity of understanding only. No unnecessary limitations are to be understood therefrom. The invention is not limited to the exact details shown and described, for variations obvious to one skilled in the art will be included within the invention defined by the claims.

What is claimed is:

1. A headgear system, comprising:

(a) an inner cap, said inner cap comprising:

(i) a head engaging and covering portion; and (ii) a visor extending outward from the head engaging and covering portion of the inner cap; and (b) a hood that is configured to fit over the inner cap, wherein said hood comprises a hood body including top, right side, left side and rear portions that provide head and neck covering portions, wherein said hood body comprises a perimeter defining a face opening, and wherein said hood is physically coupled to the visor of the inner cap in a manner to move in a corresponding fashion with the inner cap such that a movement of the inner cap causes a corresponding movement of the hood, and said hood further comprising:

a bill attached to the hood body and extending outward from the hood body and the perimeter of the face opening, said bill comprising at least an a rigid upper panel and a flexible and stretchable lower panel defining at least a portion of a pocket, wherein the lower panel comprises a flexible and stretchable material, and wherein at least a portion of the visor of the inner cap fits into at least a portion of the pocket in order to physically couple and align the hood to the inner cap, said flexible and stretchable lower panel stretching to fit and hold at least a portion of the visor inside the pocket, with the portion of the visor of the inner cap held in the pocket such that a movement of the cap causes a corresponding movement of the hood; wherein the lower panel comprises at least one of a left side edge extension and a right side edge extension that extends downward from and away from the upper panel and is directly coupled to a respective one of the left or right side of the hood body.

2. The headgear system of claim 1, wherein the hood is configured to fit over at least a portion of the head engaging and covering portion and visor of the inner cap and a neck and a head of a user.

3. The headgear system of claim 1, wherein the inner cap and the hood physically engage when the visor of the inner cap fits in the pocket of the hood without additional fasteners.

4. The headgear system of claim 1, wherein the hood is attached to a jacket.

5. The headgear system of claim 4, wherein the hood is detachably attached to the jacket.

6. The headgear system of claim 1, wherein at least one of the upper and lower panels of the bill includes a multilayer structure.

7. The headgear system of claim 1, wherein the lower panel of the bill is detachable from the upper panel of the bill and the sides of the hood body.

8. The headgear system of claim 1, wherein the lower panel of the bill is non-detachably secured to the upper panel of the bill and the sides of the hood body.

9. The headgear system of claim 1, wherein the inner cap comprises a helmet and the visor is a helmet visor that is configured to slide into the pocket of the hood.

10. The headgear system of claim 1, wherein the inner cap includes a headband.

11. The headgear system of claim 1, wherein the pocket fully encloses the visor of the inner cap.

12. A method of wearing a headgear system, comprising the steps of:

(a) wearing an inner cap, said inner cap comprising:
  (i) a head engaging and covering portion; and
  (ii) a visor extending outward from the head engaging and covering portion of the inner cap; and (b) wearing a hood that is configured to fit over the inner cap, said hood comprising:
  (i) a hood body including a top, right side, left side, and rear portions that provide head and neck covering portions, wherein said hood body comprises a perimeter defining a face opening, and wherein said hood is physically coupled to the visor of the inner cap in a manner to move in a corresponding fashion with the inner cap such that a movement of the inner cap causes a corresponding movement of the hood; and
  (ii) a bill attached to the hood body and extending outward from the hood body and the perimeter of the face opening, said bill comprising at least an a rigid upper panel and a flexible and stretchable lower panel defining at least a portion of a pocket, wherein the flexible and stretchable lower panel comprises a flexible and stretchable material, and wherein at least a portion of the visor of the inner cap fits into at least a portion of the pocket in order to physically couple and align the hood to the inner cap, and wherein the flexible and stretchable lower panel comprises at least one of a left side edge extension and a right side edge extension that extends downward from and away from the upper panel and is directly coupled to a respective one of the left or right side of the hood body; and (c) fitting the visor of the inner cap into the pocket of the hood, wherein said stretchable and flexible pocket material stretches to fit and hold at least a portion of the visor of the inner cap in the pocket such that a movement of the cap causes a corresponding movement of the hood.

13. A hood configured to interact with and fit over an inner cap configured to be worn by a user, wherein the inner cap comprises a visor, the hood comprising:

(a) a hood body including top, right side, left side and rear portions that provide head and neck covering portions, wherein said hood body comprises a perimeter defining a face opening, and wherein said hood is physically coupled to the visor of the inner cap in a manner to move in a corresponding fashion with the inner cap such that a movement of the inner cap causes a corresponding movement of the hood; and (b) a bill attached to the hood body and extending outward from the hood body and the perimeter of the face opening, said bill comprising at least a rigid upper panel and a flexible and stretchable lower panel defining at least a portion of a pocket, wherein the flexible and stretchable lower panel stretches to hold and fit the visor, and wherein at least a portion of the visor of the inner cap fits into at least a portion of the pocket in order to physically couple and align the hood to the inner cap such that a movement of the cap causes a corresponding movement of the hood; and wherein the flexible and stretchable lower panel comprises at least one of a left side edge extension and a right side edge extension that extends downward from and away from the upper panel and is directly coupled to a respective one of the left or right side of the hood body.

14. The hood of claim 13, wherein the hood physically engages with the visor of the inner cap and the visor fits into the pocket of the hood without additional fasteners.

15. The hood of claim 13, wherein at least one of the upper and lower panels of the bill includes a multilayer structure.

16. The hood of claim 13, further comprising a neck covering portion that is configured to cover at least a portion of a neck of a user.

* * * * *